US010265975B2

(12) United States Patent
Ogasahara

(10) Patent No.: US 10,265,975 B2
(45) Date of Patent: Apr. 23, 2019

(54) INKJET RECORDING APPARATUS

(71) Applicant: KYOCERA Document Solutions Inc., Osaka (JP)

(72) Inventor: Okito Ogasahara, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/872,548

(22) Filed: Jan. 16, 2018

(65) Prior Publication Data

US 2018/0207962 A1 Jul. 26, 2018

(30) Foreign Application Priority Data

Jan. 20, 2017 (JP) ..... 2017-008181

(51) Int. Cl.
*B41J 13/00* (2006.01)
*B41J 2/165* (2006.01)
*B41J 2/21* (2006.01)

(52) U.S. Cl.
CPC ..... *B41J 13/0009* (2013.01); *B41J 2/16579* (2013.01); *B41J 2/16585* (2013.01); *B41J 2/2142* (2013.01); *B41J 2/2146* (2013.01); *B41J 2002/16591* (2013.01)

(58) Field of Classification Search
CPC .. B41J 2/04508; B41J 2/04586; B41J 2/2139; B41J 13/0009; B41J 2002/16591; B41J 2/2146; B41J 2/2142; B41J 2/16585; B41J 2/16579; H04N 1/4057; H04N 1/6016; H04N 1/6022; H04N 1/6097; G06K 2215/0094
See application file for complete search history.

(56) References Cited

U.S. PATENT DOCUMENTS 9,789,684 B2 * 10/2017 Saito ..... H04N 1/3873

FOREIGN PATENT DOCUMENTS

JP 2006-240141 A 9/2006

* cited by examiner

*Primary Examiner* — Thinh H Nguyen
(74) *Attorney, Agent, or Firm* — Stein IP, LLC

(57) ABSTRACT

A control section of an inkjet recording apparatus forms a test chart between both ends of a recording medium in a recording-medium width direction by drawing a plurality of line sets, in each of which there are arranged a predetermined number of lines each extending in a recording-medium conveyance direction and each drawn with ink ejected from a single one of the plurality of ink ejection nozzles, by sequentially shifting the plurality of line sets by one line in the recording-medium width direction, each time the recording medium proceeds a predetermined distance in the recording-medium conveyance direction. Further, the control section detects, by using the detection section, presence/absence of ink on each of the plurality of lines drawn in the test chart, and determines presence/absence of a defective pixel, and a position of the defective pixel.

4 Claims, 5 Drawing Sheets

INKJET RECORDING APPARATUS

INCORPORATION BY REFERENCE

This application is based upon and claims the benefit of priority from the corresponding Japanese Patent Application No. 2017-008181 filed on Jan. 20, 2017, the entire contents of which are incorporated herein by reference.

BACKGROUND

The present disclosure relates to an inkjet recording apparatus.

As image forming apparatuses, such as copiers and printers, inkjet recording apparatuses have been widely spread in recent years. Inkjet recording apparatuses can be classified into those of a serial type, in which recording is performed while a recording head is scanning across a recording medium such as a sheet, and those of a line-head type, in which recording is performed by a recording head fixed to the apparatus main body.

In order to continue high-quality recording with an inkjet recording apparatus, it is necessary to appropriately monitor clogging of ink ejection nozzles provided in a recording head. As a solution to this, in the field of inkjet recording apparatuses, a conventional technique is known in which a test chart constituted by a predetermined pattern image is recorded on a sheet and clogging of an ink ejection nozzle is found by detecting presence/absence of ink on the test chart.

An inkjet recording apparatus according to this conventional technique records a predetermined non-discharge detection pattern (a test chart) on a recording medium. The non-discharge detection pattern includes a dot-shaped pattern for specifying the identification number of a nozzle in a recording head, and a substantially line-shaped pattern for detecting non-discharge of each nozzle. By recording this non-discharge detection pattern on a recording medium, it is possible to detect non-discharge of all the nozzles in the recording head.

SUMMARY

According to an aspect of the present disclosure, an inkjet recording apparatus includes a conveyance section, a recording section, a detection section, and a control section. The conveyance section conveys a recording medium. The recording section is disposed to face the recording medium conveyed by the conveyance section, has a recording head in which a plurality of ink ejection nozzles are arranged along a recording-medium width direction which crosses a recording-medium conveyance direction, and ejects ink onto the recording medium. The detection section is disposed to face the recording medium conveyed by the conveyance section, has a plurality of detection elements arranged along the recording-medium width direction corresponding to the plurality of ink ejection nozzles, and detects presence/absence of ink ejected by the recording section onto the recording medium. The control section controls operations of the conveyance section and the recording section. The control section forms a test chart between both ends of the recording medium in the recording-medium width direction by drawing a plurality of line sets, in each of which there are arranged, along the recording-medium width direction, a predetermined number of lines each extending in the recording-medium conveyance direction and each drawn with ink ejected from a single one of the plurality of ink ejection nozzles, by sequentially shifting the plurality of line sets by one line in the recording-medium width direction, each time the recording medium proceeds a predetermined distance in the recording-medium conveyance direction. The control section, by using the detection section, detects presence/absence of ink on each one of the plurality of lines drawn in the test chart, and determines presence/absence of a defective pixel, and a position of the defective pixel.

DETAILED DESCRIPTION

Embodiments of the present disclosure will be described below with reference to the accompanying drawings. The present disclosure is not limited to what is specifically mentioned below.

Figure 1:
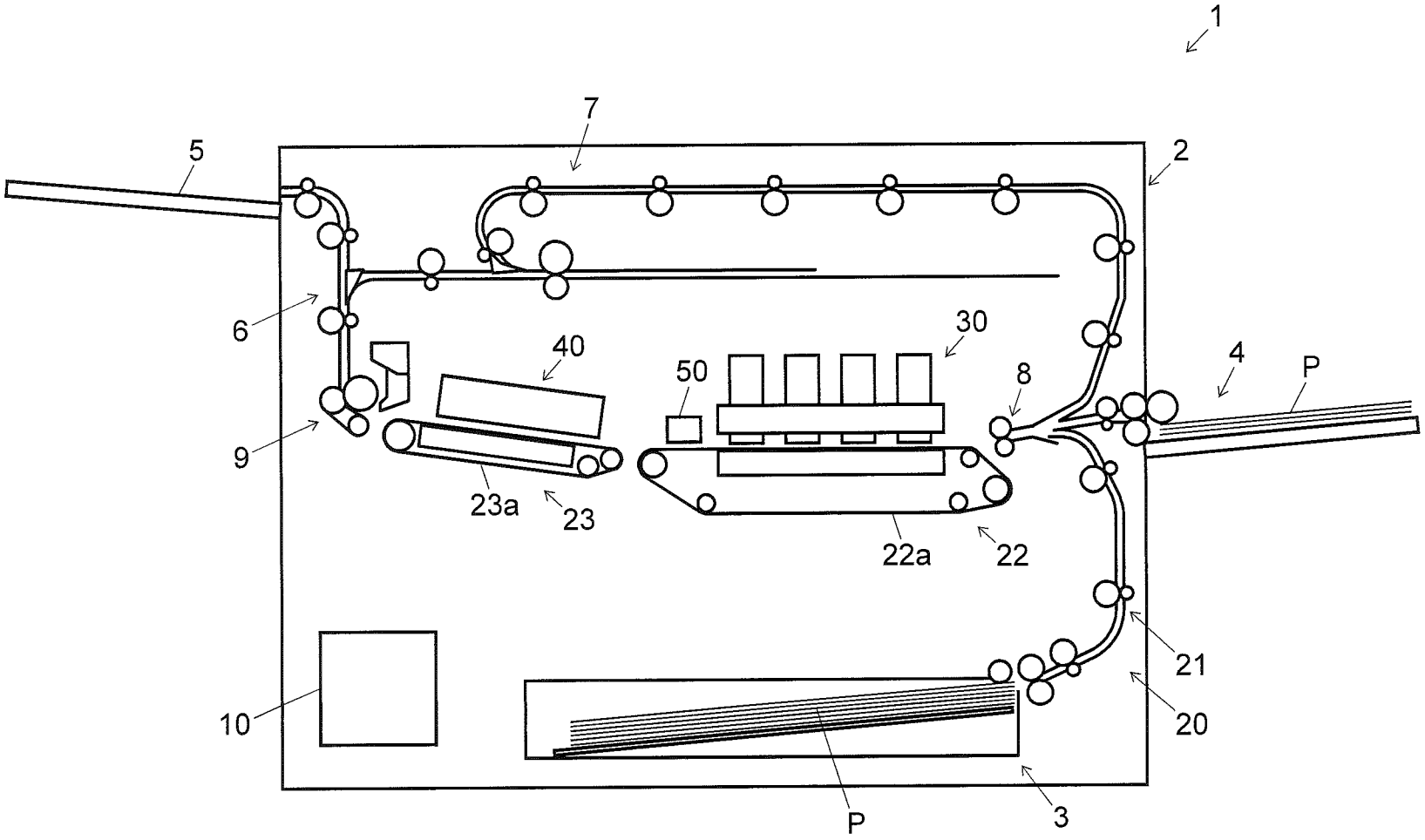
FIG. 1 is a front vertical sectional view of an inkjet recording apparatus according to an embodiment of the present disclosure.
Figure 2:
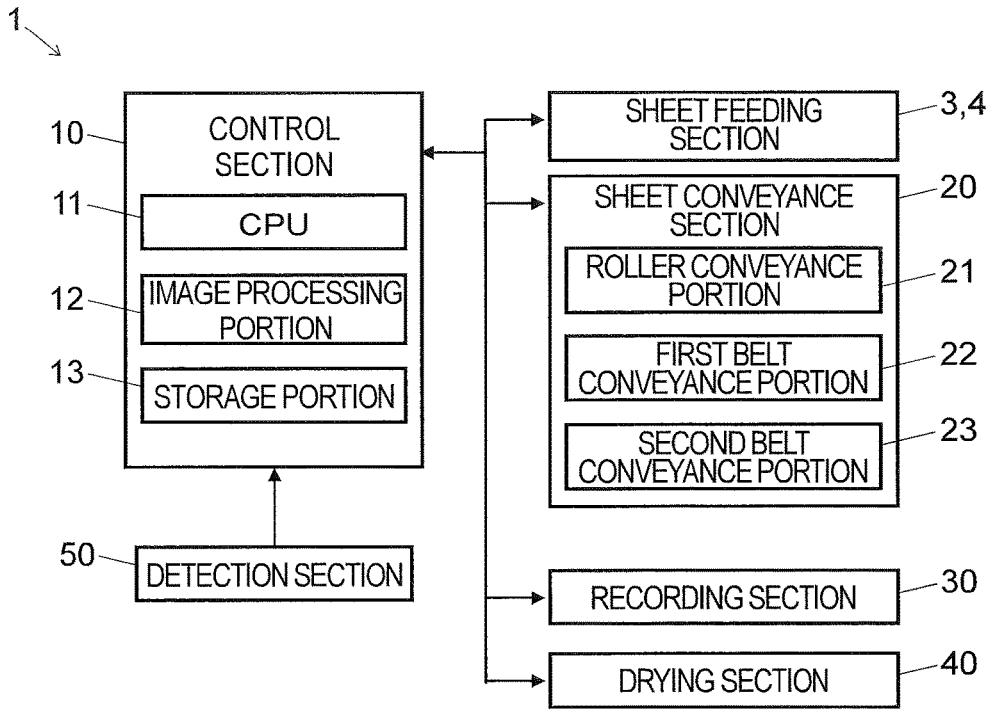
FIG. 2 is a block diagram illustrating a configuration of the inkjet recording apparatus according to the embodiment of the present disclosure.

First, a description will be given of an inkjet recording apparatus according to an embodiment of the present disclosure, with reference to FIG. 1 and FIG. 2. FIG. 1 is an example of front vertical sectional view illustrating a schematic configuration of the inkjet recording apparatus. FIG. 2 is a block diagram illustrating a configuration of the inkjet recording apparatus.

The inkjet recording apparatus 1 illustrated in FIG. 1 and FIG. 2, which employs an inkjet recording method, is what is called a printer. The inkjet recording apparatus 1 includes a sheet feeding cassette 3 and a manual sheet feeding tray 4 as a sheet feeding section for feeding a sheet P as a recording medium.

The sheet feeding cassette 3 is disposed at a lower portion of an inside of a main body 2 of the inkjet recording apparatus 1. The manual sheet feeding tray 4 is disposed on an outer right side surface of the main body 2. The sheet feeding cassette 3 and the manual sheet feeding tray 4 each accommodate a plurality of sheets P, and feed them to a sheet conveyance section 20 separately one by one during printing.

The sheet conveyance section 20 is disposed on a downstream side of the sheet feeding cassette 3 and the manual sheet feeding tray 4 with respect to a sheet conveyance direction. The sheet conveyance section 20 includes a roller conveyance portion 21, a first belt conveyance portion 22, and a second belt conveyance portion 23. The roller conveyance portion 21 conveys the sheet P by nipping it in a nip portion of a pair of rollers which contact each other by being pressed against each other. The first belt conveyance portion 22 and the second belt conveyance portion 23 adsorb, hold, and convey the sheet P on upper surfaces thereof, which are respectively a sheet conveyance surface of a first conveyance belt 22*a* and a sheet conveyance surface of a second conveyance belt 23*a*. The sheet conveyance section 20 conveys the sheet P fed out from the sheet feeding cassette 3 or the manual sheet feeding tray 4 to a recording section 30 and a drying section 40, and further discharges the sheet P into a sheet discharge tray 5 after recording and drying operations are performed with respect to the sheet P.

The sheet conveyance section 20 includes a switching portion 6 on an upstream side of the sheet discharge tray 5 with respect to the sheet conveyance direction. In a case where two-side printing is to be performed, the sheet P is conveyed from the switching portion 6 to a sheet turning-over portion 7, which is disposed above the recording section 30 and the drying section 40. Through the sheet turning-over portion 7, the conveyance direction of the sheet P is switched to turn it upside down, and then the sheet P is conveyed through an upper portion of the main body 2, and then conveyed back to an upstream side of the recording section 30.

The sheet conveyance section 20 includes a registration roller pair 8, which is disposed on the upstream side of the recording section 30 with respect to the sheet conveyance direction. The registration roller pair 8 corrects oblique feeding of the sheet P and, with timing coordinated with an ink ejecting operation executed by the recording section 30, feeds out the sheet P toward the first belt conveyance portion 22.

The recording section 30 is disposed over the first belt conveyance portion 22 so as to face the sheet P conveyed by the first belt conveyance portion 22. The recording section 30 includes recording heads 32K, 32Y, 32M, and 32C, which are line-type inkjet heads corresponding to four colors of black, yellow, magenta, and cyan, respectively (see FIG. 3). The recording section 30 ejects ink onto the sheet P conveyed by being adsorbed and held on the first conveyance belt 22*a*, sequentially from the recording heads 32K, 32Y, 32M, and 32C, to thereby record a full color image in which black, yellow, magenta and cyan inks are superimposed. Further, with the inkjet recording apparatus 1, it is also possible to record a monochrome image.

The drying section 40 is arranged on a downstream side of the recording section 30 with respect to the sheet conveyance direction, and the second belt conveyance portion 23 is disposed under the drying section 40. After having an ink image recorded thereon at the recording section 30, the sheet P is conveyed under the drying section 40 by being adsorbed and held on the second conveyance belt 23*a*, during which ink on the sheet P is dried by the drying section 40.

At a position on a downstream side of the drying section 40 with respect to the sheet conveyance direction, near a left side surface of the main body 2, there is disposed a decurler portion 9. The sheet P, having the ink thereon dried at the drying section 40, is sent to the decurler portion 9, where curling caused in the sheet P is corrected.

The inkjet recording apparatus 1 further includes a control section 10. The control section 10 includes a CPU 11, an image processing portion 12, a storage portion 13, and other unillustrated electronic components and circuits. The CPU 11 controls operations of various components of the inkjet recording apparatus 1, such as the sheet conveyance section 20 and the recording section 30, based on control programs and data stored in the storage portion 13, and performs recording processing with respect to the sheet P. The image processing portion 12 performs, with respect to image data received from an external computer, image processing for realizing suitable recording. The storage portion 13 comprises, for example, a combination of a non-volatile storage device, such as a program ROM and a data ROM, and a volatile storage device, such as a RAM, of which none is illustrated.

Figure 3:
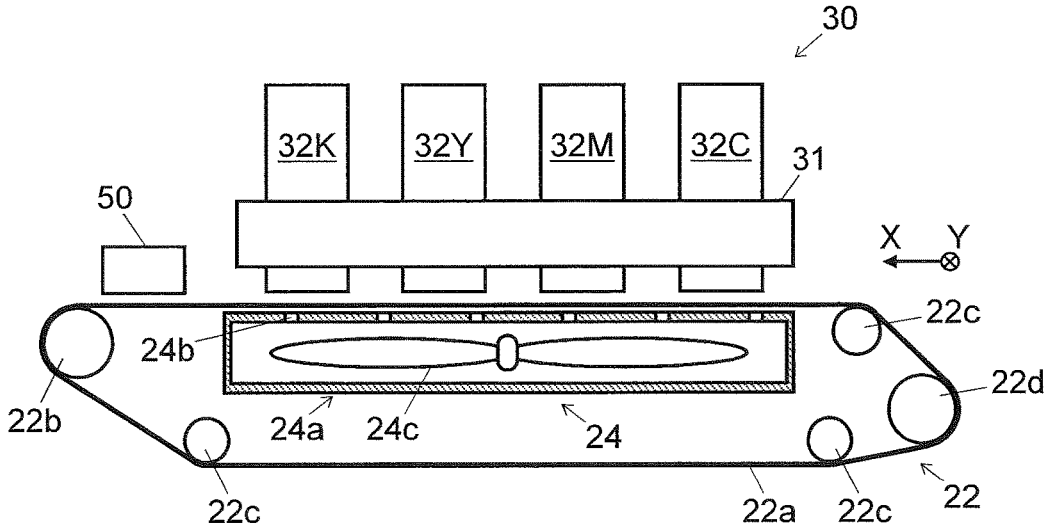
FIG. 3 is a front view of a recording section and the vicinity thereof in the inkjet recording apparatus according to the embodiment of the present disclosure.
Figure 4:
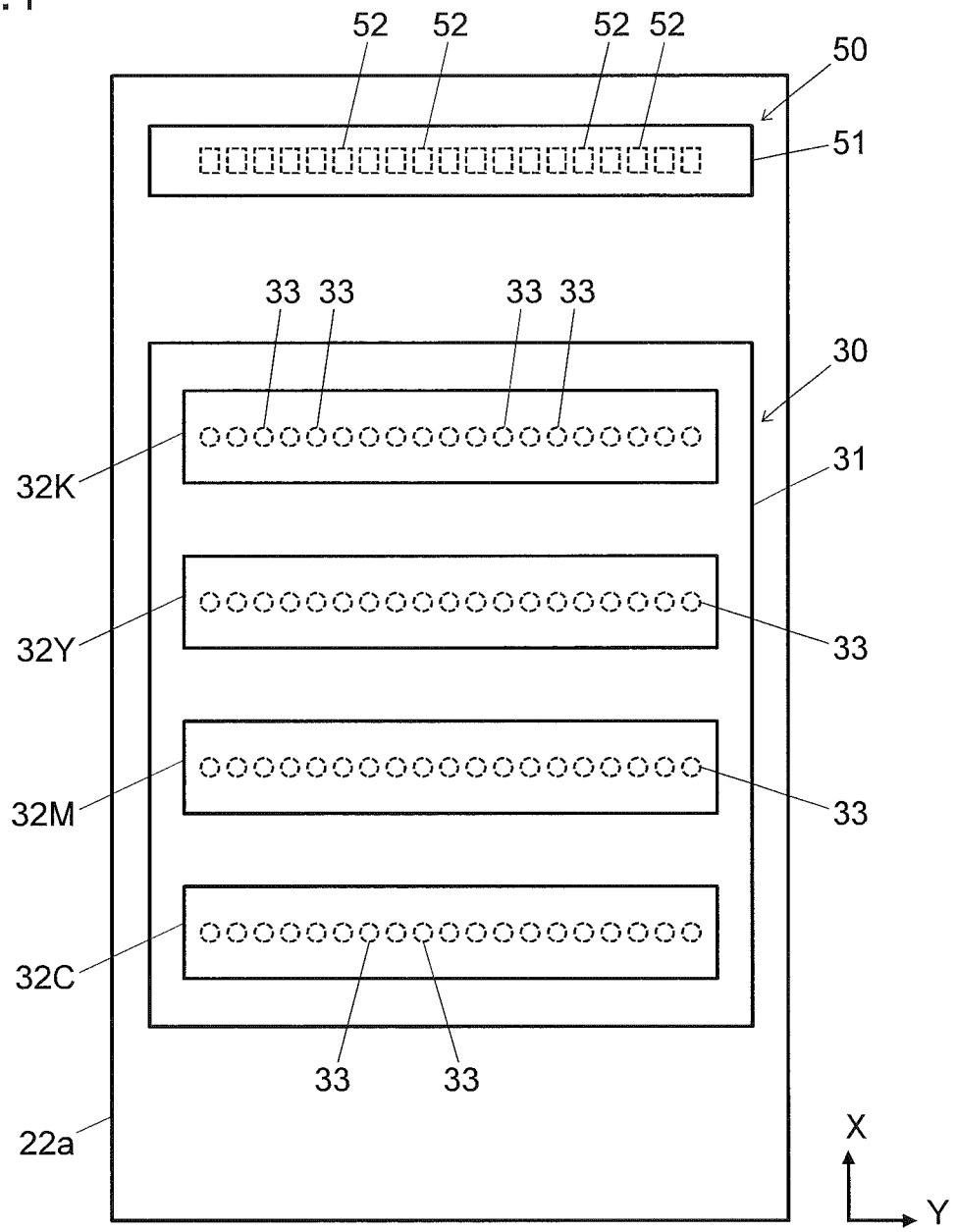
FIG. 4 is a top view of the recording section and the vicinity thereof in the inkjet recording apparatus according to the embodiment of the present disclosure.

Next, detailed configurations of the recording section 30 and the vicinity thereof will be described, with reference to FIG. 3 and FIG. 4. FIG. 3 and FIG. 4 are a front view and a top view, respectively, of the recording section 30 and the vicinity thereof. In FIG. 3 and FIG. 4, arrow X indicates the sheet conveyance direction, in which sheets P are conveyed, and arrow Y indicates the sheet width direction of sheets P, which is perpendicular to the sheet conveyance direction.

The first belt conveyance portion 22 includes, in addition to the first conveyance belt 22*a*, a drive roller 22*b*, a driven roller 22*c*, and a tension roller 22*d*. The first conveyance belt 22*a* is an endless belt wound around the drive roller 22*b*, the driven roller 22*c*, and the tension roller 22*d*. The first conveyance belt 22*a* is caused by the drive roller 22*b* to rotate in a counterclockwise direction in FIG. 3. The sheet P fed out from the registration roller pair 8 is conveyed from right to left in FIG. 3 in a state of being adsorbed and held on an upper surface of the first conveyance belt 22*a*, and passes under the recording section 30.

Inside the first conveyance belt 22*a*, at a position facing a back side of the sheet conveyance surface of the first conveyance belt 22*a*, a sheet suction portion 24 is disposed. The sheet suction portion 24 includes a large number of holes 24*b*, which are formed in a top surface of a housing 24*a* thereof to penetrate the top surface to allow communication between inside and outside of the housing 24*a*, and a suction fan 24*c*, which is disposed inside the housing 24*a*. The sheet suction portion 24 is capable of sucking air downward through the top surface of the housing 24*a* by driving the suction fan 24*c*. Further, the first conveyance belt 22*a* also includes a large number of holes (not shown) for air suction, which penetrate the first conveyance belt 22*a* in its thickness direction. With this configuration, the first belt conveyance portion 22 conveys the sheet P while adsorbing and holding the sheet P on the top surface, that is to say, the sheet conveyance surface, of the first conveyance belt 22*a*.

The recording section 30 includes a head housing 31, in addition to the recording heads 32K, 32Y, 32M, and 32C. The recording heads 32K, 32Y, 32M, and 32C are held by the head housing 31. The recording heads 32K, 32Y, 32M, and 32C each have a shape extending along the sheet width direction, and the four recording heads are arranged in one line along the sheet conveyance direction. Note that the recording heads 32 have the same basic structure, and thus the color identification signs will sometimes be omitted.

The recording heads 32 are supported over the first conveyance belt 22*a*, at a predetermined distance (1 mm, for example) from the sheet conveyance surface of the first conveyance belt 22*a*. The recording heads 32 each have a recording region, which is as wide as or wider than the width of the sheet P conveyed by the first conveyance belt 22*a*, with respect to the sheet width direction.

As shown in FIG. 4, each of the recording heads 32 includes a plurality of ink ejection nozzles 33 provided in an ink ejection portion thereof, which is a bottom portion thereof. The plurality of ink ejection nozzles 33 are arranged along the sheet width direction such that they are able to eject ink over the whole recording region. The ink ejection nozzles 33 of the respective colors sequentially receive supply of ink from unillustrated ink tanks.

On a downstream side of the recording heads 32 with respect to the sheet conveyance direction, a detection section 50 is disposed. The detection section 50 is disposed above the first belt conveyance portion 22 to face the sheet P conveyed by the first belt conveyance portion 22. The detection section 50 is supported over the first conveyance belt 22*a*, at a predetermined distance from the sheet conveyance surface of the first conveyance belt 22*a*. The detection section 50 has a detection region, which is as wide as or wider than the width of the sheet P conveyed by the first conveyance belt 22*a*, with respect to the sheet width direction.

The detection section 50 is constituted by a contact image sensor, for example, and has, accommodated in a housing 51 thereof, a detection element 52, and an unillustrated light source and an unillustrated lens. The detection element 52 comprises substantially the same number of photoelectric conversion elements as the plurality of ink ejection nozzles 33, the photoelectric conversion elements being arranged along the sheet width direction, corresponding to the plurality of ink ejection nozzles 33. In the detection section 50, the light source emits light toward the sheet P, from which the light is reflected to be received by the detection element 52 via the lens, and thereby the detection section 50 detects the presence/absence of ink ejected onto the sheet P by the recording section 30. By using a contact image sensor, it is possible to reduce space occupied by the detection section 50, and this helps make the inkjet recording apparatus 1 compact. Furthermore, it is possible to reduce occurrence of optical distortion with respect to a detection result, and this contributes to improvement in detection accuracy.

The inkjet recording apparatus 1 configured as described above has a nozzle checking function for finding clogging of the ink ejection nozzles 33.

Figure 5:
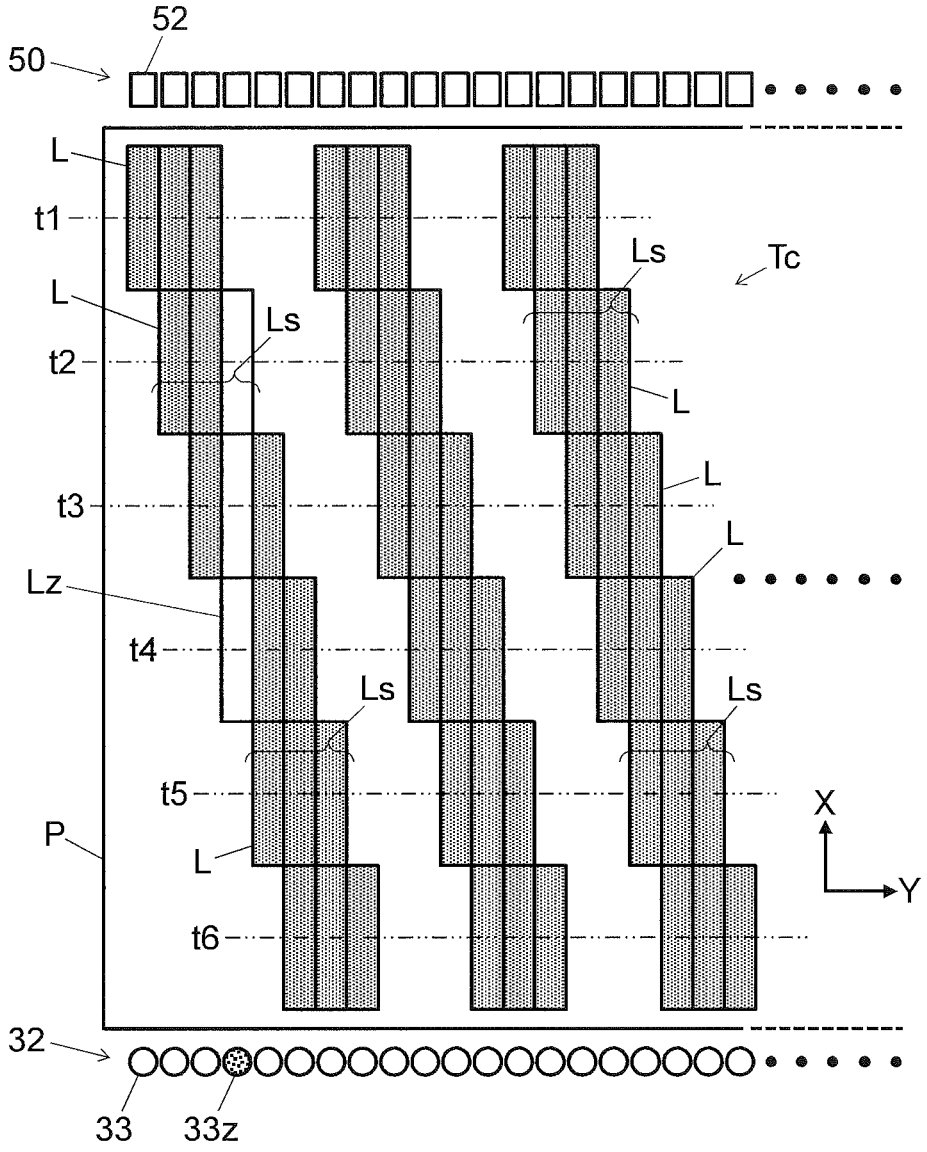
FIG. 5 is a top view of a test chart used for a nozzle checking function of the inkjet recording apparatus according to the embodiment of the present disclosure.
Figure 6:
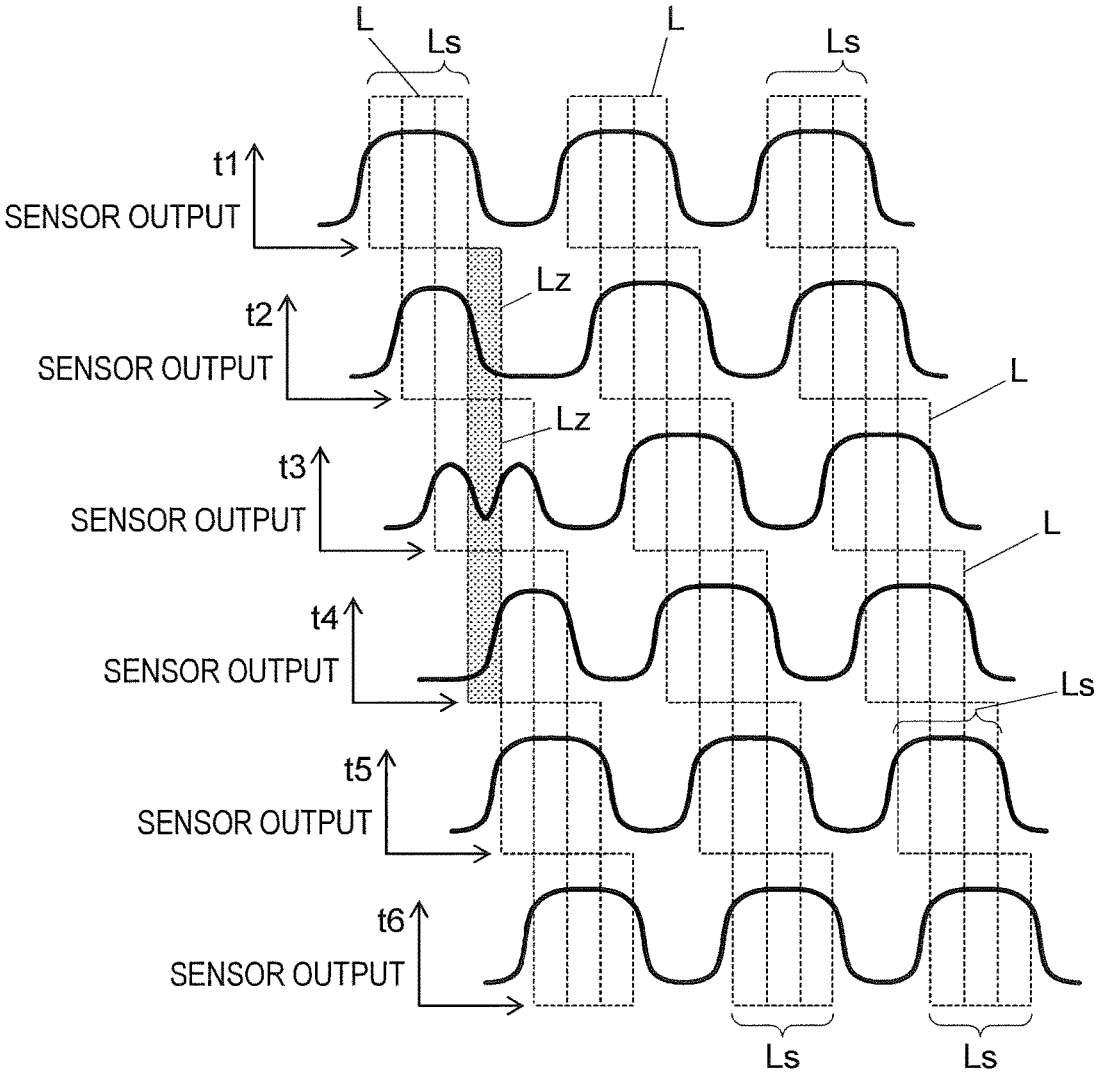
FIG. 6 is an explanatory diagram illustrating a sensor output of the test chart of the inkjet recording apparatus according to the embodiment of the present disclosure.

Next, a description will be given of the nozzle checking function of the inkjet recording apparatus 1 with reference to FIG. 5 and FIG. 6. FIG. 5 is a top view of a test chart used for the nozzle checking function of the inkjet recording apparatus 1. FIG. 6 is an explanatory diagram illustrating a sensor output of the test chart.

In the inkjet recording apparatus 1, in the nozzle checking function, the control section 10 records on the sheet P a test chart Tc shown in FIG. 5, which is constituted by a predetermined pattern image.

The test chart Tc is formed such that a plurality of lines L extending in the sheet conveyance direction are each drawn with ink ejected from a single one of the plurality of ink ejection nozzles 33 between two ends of the sheet P in the sheet width direction. The test chart Tc has a plurality of line sets Ls, in each of which a predetermined number of (for example, three) lines L are arranged along the sheet width direction. The plurality of line sets Ls are drawn by being shifted by one line in the sheet width direction each time the sheet P proceeds a predetermined distance in the sheet conveyance direction.

The detection section 50, with respect to the test chart Tc on the sheet P conveyed by the first conveyance belt 22*a*, at timings represented by positions t1, t2, t3, t4, t5, and t6 indicated by two-dot chain lines, detects the presence/absence of ink in each of the plurality of line sets Ls drawn in the test chart Tc. FIG. 6 illustrates sensor outputs of the test chart Tc, as a result of the detection.

Here, assume that clogging has occurred in an ink ejection nozzle 33*z* shown in FIG. 5. Thereby, line Lz drawn with ink ejected from the ink ejection nozzle 33*z*, which has ejected only a small amount of ink, becomes a defective pixel.

According to FIG. 6, it is detected that sensor outputs of such ones of the line sets Ls as do not include line Lz corresponding to the ink ejection nozzle 33*z* are appropriate in both output value and output length in the sheet width direction. Based on this detection result, the control section 10 determines that such ones of the line sets Ls as do not include line Lz do not include any defective pixel and thus are appropriate.

On the other hand, it is detected that sensor outputs with respect to the line set Ls including line Lz corresponding to the ink ejection nozzle 33*z*, detected at the timings represented by positions t2, t3, and t4, are inappropriate at least in either output value or output length in the sheet width direction. Based on this detection result, the control section 10 determines that the line set Ls including line Lz has a defective pixel, and thus is inappropriate.

And, it is detected that, at position t2, in the left-end line set Ls in FIG. 6, in the sensor output, the output length is short in the right side region in the sheet width direction. Also, it is detected that, at position t3, in the left-end line set Ls in FIG. 6, in the sensor output, the output value is low in the center region in the sheet width direction. Further, it is detected that, at position t4, in the left-end line set Ls in FIG. 6, in the sensor output, the output length is short in the left side region in the sheet width direction. The control section 10 can determine the position of line Lz, which has a defective pixel, based on these detection results.

With the configuration described above, in the case where the detection section 50 has substantially the same number of detection elements 52 as the ink ejection nozzles 33 corresponding to the plurality of ink ejection nozzles 33, even when the positions of the detection elements 52 and the positions of the lines L in the test chart Tc recorded on the sheet P do not coincide in the sheet width direction, it is possible to determine the position of the line Lz having a defective pixel, that is, the position of the ink ejection nozzle 33*z*. Accordingly, it becomes possible to correctly find clogging occurring in the ink ejection nozzle 33*z*.

The control section 10 draws, in the test chart Tc, a plurality of line sets Ls such that the plurality of line sets Ls are arranged to be spaced from each other by a predetermined distance along the sheet width direction, by sequentially shifting the plurality of line sets Ls by one line in the sheet width direction each time the sheet P proceeds a predetermined distance in the sheet conveyance direction. For example, as shown in FIG. 5, in the test chart Tc, a plurality of line sets Ls, in each of which three lines L are arranged, are arranged along the sheet width direction spaced from each other by a distance corresponding to three lines, in other words, a distance corresponding to three nozzles. And, in the test chart Tc, the plurality of line sets Ls are drawn by being sequentially shifted by one line in the sheet width direction each time the sheet P proceeds a predetermined distance in the sheet conveyance direction.

Thereby, it is possible to form, in a relatively narrow area in the sheet conveyance direction, a test chart Tc in which lines L are drawn with respect to all the ink nozzles 33 arranged in the sheet width direction. Accordingly, it becomes possible to correctly find clogging occurring in an ink ejection nozzle 33 by using as small a number of sheets P as possible.

The control section 10 draws, in the test chart Tc, the same number of lines L with respect to each of the plurality of ink ejection nozzles 33 as are arranged in each of the plurality of line sets Ls. For example, as illustrated in FIG. 5, in the test chart Tc, three lines L are arranged in each line set Ls, and the plurality of ink ejection nozzles 33 each draw a line L three times. That is, the three lines L drawn by a single one of the plurality of ink ejection nozzles 33 are respectively included in three different ones of the plurality of line sets Ls. And also, the positions of the three lines L in the respective line sets Ls in the sheet width direction are different, such that one is located at the left side, another is located at the center, and the other is located at the right side, in the sheet width direction, in FIG. 5.

Thereby, it becomes possible to specify the positions of each of the plurality of ink ejection nozzles 33 in the line sets Ls with the minimum number of times of drawing.

It should be understood that the embodiments of the present disclosure described above are in no way meant to limit its scope; the present disclosure can be implemented with any modifications made without departing from its spirit.

For example, in the above embodiments, the ink ejection nozzles 33 are arranged in one line in the sheet width direction as shown in FIG. 4, but this arrangement is not meant as a limitation. In each of the recording heads 32, the ink ejection nozzles 33 may be disposed in a staggered arrangement in the sheet width direction. Or, for example, they may be arranged such that a plurality of sets of ink ejection nozzles 33, in each of which a predetermined number of ink ejection nozzles 33 are arranged in a line diagonal to both the sheet conveyance direction and the sheet width direction, are arranged in the sheet width direction. Or, each of the recording heads 32 may be divided into a plurality of parts with respect to the sheet width direction, and the parts in each of the recording heads 32 may be disposed in a staggered arrangement in the sheet width direction.

As the detection section 50, a sensor using a charge coupled device (CCD), for example, may be used instead of the contact image sensor.

What is claimed is:

1. An inkjet recording apparatus comprising:

a conveyance section which conveys a recording medium;

a recording section which is disposed to face the recording medium conveyed by the conveyance section, which has a recording head in which a plurality of ink ejection nozzles are arranged along a recording-medium width direction which crosses a recording-medium conveyance direction, and which ejects ink onto the recording medium;

a detection section which is disposed to face the recording medium conveyed by the conveyance section, which has a plurality of detection elements which are arranged along the recording-medium width direction corresponding to the plurality of ink ejection nozzles, and which detects presence/absence of ink ejected by the recording section onto the recording medium; and a control section which controls operations of the conveyance section and the recording section, wherein the control section forms a test chart between both ends of the recording medium in the recording-medium width direction, the test chart having a plurality of line sets, in each of which there are arranged, by using some adjacent ones of the plurality of ink nozzles, along the recording-medium width direction, a predetermined number of lines each extending in the recording-medium conveyance direction and each drawn with ink ejected from a single one of the plurality of ink ejection nozzles, in the test chart, a plurality of the lines being arranged in the recording-medium conveyance direction with respect to each of the plurality of ink ejection nozzles by sequentially shifting the plurality of line sets by one line in the recording-medium width direction, each time the recording medium proceeds a predetermined distance in the recording-medium conveyance direction, detects, by using the detection section, presence/absence of ink on each of the plurality of lines drawn in the test chart, and determines presence/absence of a defective pixel, and a position of the defective pixel.

2. The inkjet recording apparatus according to claim 1, wherein the control section draws, in the test chart, the plurality of line sets such that the plurality of line sets are arranged to be spaced from each other by a predetermined distance along the recording-medium width direction, by sequentially shifting the plurality of line sets by one line in the recording-medium width direction, each time the recording medium proceeds a predetermined distance in the recording-medium conveyance direction.

3. The inkjet recording apparatus according to claim 1, wherein, in the test chart, the control section draws a same number of lines with respect to each of the plurality of ink ejection nozzles as there are arranged in each of the plurality of line sets.

4. The inkjet recording apparatus according to claim 1, wherein the detection section is a contact image sensor which has, as the plurality of detection elements, a plurality of photoelectric conversion elements arranged along the recording-medium width direction.

* * * * *